US012298094B2

(12) United States Patent
White

(10) Patent No.: US 12,298,094 B2
(45) Date of Patent: May 13, 2025

(54) FIREARM SECURITY DEVICE

(71) Applicant: Joseph White, Richmond, VA (US)

(72) Inventor: Joseph White, Richmond, VA (US)

( * ) Notice: Subject to any disclaimer, the term of this patent is extended or adjusted under 35 U.S.C. 154(b) by 0 days.

(21) Appl. No.: 18/121,929

(22) Filed: Mar. 15, 2023

(65) Prior Publication Data

US 2024/0310134 A1 Sep. 19, 2024

(51) Int. Cl.
*F41A 17/06* (2006.01)

(52) U.S. Cl.
CPC ..... *F41A 17/066* (2013.01)

(58) Field of Classification Search
CPC ..... F41A 17/06; F41A 17/066
See application file for complete search history.

(56) References Cited

U.S. PATENT DOCUMENTS 4,682,435 A * 7/1987 Heltzel ..... F41A 17/063 42/70.11
8,381,426 B2 * 2/2013 Chang ..... F41A 17/066 42/70.08
9,644,911 B1 * 5/2017 McLean, III ..... F41A 17/063
9,857,133 B1 * 1/2018 Kloepfer ..... G06F 21/32
10,914,543 B2 * 2/2021 Dulude ..... F41A 5/04
11,692,783 B2 * 7/2023 Chandler ..... H02J 50/10 42/70.06
11,892,253 B1 * 2/2024 Tzamarot ..... F41A 17/063
11,920,880 B2 * 3/2024 Chandler ..... F41A 17/46
2011/0271574 A1 * 11/2011 Chang ..... F41A 17/066 42/70.08
2013/0125441 A1 * 5/2013 Westwood ..... F41A 17/28 42/70.11
2014/0366419 A1 * 12/2014 Allan ..... F41A 17/06 42/70.11
2017/0146310 A1 * 5/2017 Biran ..... F41A 17/066
2019/0376756 A1 * 12/2019 Nieh ..... F41A 17/08
2020/0400398 A1 * 12/2020 Dulude ..... F41A 17/38
2021/0231398 A1 * 7/2021 Dulude ..... F41A 17/066
2022/0178639 A1 * 6/2022 Song ..... F41A 17/06
2023/0047756 A1 * 2/2023 Chandler ..... F41A 17/04
2023/0073712 A1 * 3/2023 Chandler ..... F41A 17/46
2023/0075844 A1 * 3/2023 Chandler ..... F41A 17/066
2023/0077252 A1 * 3/2023 Chandler ..... F41A 17/06
2023/0168056 A1 * 6/2023 Galie ..... F41A 17/06 42/69.03

OTHER PUBLICATIONS

Daniel G. J., New Nanotech Set to Track, Self-destruct, and GPS Tag Guns Wirelessly, Aug. 11, 2013: http://www.infowars.com/new-nanotech-set-to-track-self-destruct-and-gps-tag-guns-wirelessly/ (Year: 2013).*

* cited by examiner

*Primary Examiner* — Joshua E Freeman
(74) *Attorney, Agent, or Firm* — The Iwashko Law Firm, PLLC; Lev Ivan Gabriel Iwashko

(57) ABSTRACT

A firearm security device removably connected to at least a portion of a firearm, the firearm security device including a biometric sensor to scan a physical characteristic of a user and send biometric data therefrom, a control unit running a program thereon and connected to the biometric sensor to compare the biometric data received from the biometric sensor to user data to determine whether the user is an authorized user of the firearm, and a locking pin disposed on a trigger bar of the firearm and connected to the control unit to prevent use of the firearm until the control unit determines the user is authorized to use the firearm.

9 Claims, 5 Drawing Sheets

FIREARM SECURITY DEVICE

BACKGROUND

1. Field

The present general inventive concept relates generally to firearms, and particularly, to a firearm security device.

2. Description of the Related Art

In modern times, many people are faced with tragedy as a result of mass shootings resulting in severe injury and/or death. News stories commonly focus on mass shootings that occur at schools, churches, and/or malls with victims being both children and/or adults. It is estimated that gun-related injuries affect over forty-five thousand people annually.

Currently, some legal remedies to curb gun violence include background checks and age limits on purchase. Such measures are a proactive means to keeping guns out of the hands of individuals who are likely to harm themselves and/or others, before they act and can be an effective way to prevent gun violence. Still, once a person obtains a gun, there is not much that can prevent a shooting event. In particular, it is impossible to monitor a mentally disabled person, a psychiatrically disabled person, and/or a child who obtains the gun to commit the shooting event.

A firing pin within the gun is a thin, simple rod with a hardened, rounded tip that strikes and crushes a primer (i.e., a chemical or device used to initiate propellant combustion to push a bullet out of a gun barrel. The rounded tip ensures the primer is indented rather than pierced (to contain propellant gasses). It sits within a hole through a breechblock and is struck by the hammer when the trigger is "pulled". A light firing-pin spring is often used to keep the firing pin rearward. It may be termed a firing-pin return spring, since it returns it to the unfired position. In semi-automatic firearms, this prevents premature firing from the inertia of the firing pin as the breech mechanism closes in the reloading part of the firing cycle. Also, a striker derives the impact force to strike the primer from a spring acting directly upon the firing pin.

Thus, controlling the firing pin can determine whether the gun will fire.

Therefore, there is a need for a firearm security device that checks a user for authorization prior to use of a firearm.

SUMMARY

The present general inventive concept provides a firearm security device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a firearm security device removably connected to at least a portion of a firearm, the firearm security device including a biometric sensor to scan a physical characteristic of a user and send biometric data therefrom, a control unit running a program thereon and connected to the biometric sensor to compare the biometric data received from the biometric sensor to user data to determine whether the user is an authorized user of the firearm, and a locking pin disposed on a trigger bar of the firearm and connected to the control unit to prevent use of the firearm until the control unit determines the user is authorized to use the firearm.

The biometric sensor may scan for at least one of a fingerprint, a face, an eye, a scent, a heartbeat and a temperature level of the user.

The locking pin may contain at least one of an explosive and a caustic acid therein.

The locking pin may destroy the trigger bar in response to the control unit determining the locking pin is being removed or attempting to be removed by the user using an application of force.

The foregoing and/or other features and utilities of the present general inventive concept may also be achieved by providing a firearm security device connected to at least a portion of a firearm, the firearm security device including a biometric sensor to scan a physical characteristic of a user and send biometric data therefrom, a control unit running a program thereon and connected to the biometric sensor to compare the biometric data received from the biometric sensor to user data to determine whether the user is at least one registered user of the firearm, and a locking pin comprising a solenoid disposed on a trigger bar of the firearm and connected to the control unit to prevent use of the firearm until the control unit retracts the locking pin from the trigger bar in response to determining the user is authorized to use the firearm.

The biometric sensor may scan for at least one of a fingerprint, a face, an eye, a scent, a heartbeat and a temperature level of the user.

The control unit may set a timer for a predetermined period of time to automatically move the locking pin onto the trigger bar after the control unit determines the firearm has fired a projectile.

The locking pin may move in response to adjustment of a magnetic field of the locking pin by the control unit.

The firearm security device may further include an indicator connected to the control unit to illuminate at least one color to identify a current status of the locking pin with respect to the trigger bar.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Firearm Security Device 100
Biometric Sensor 110
Control Unit 120
Locking Pin 130
Firearm Security Device 200
Biometric Sensor 210
Control Unit 220
Locking Pin 230
Indicator 240

Figure 1A:
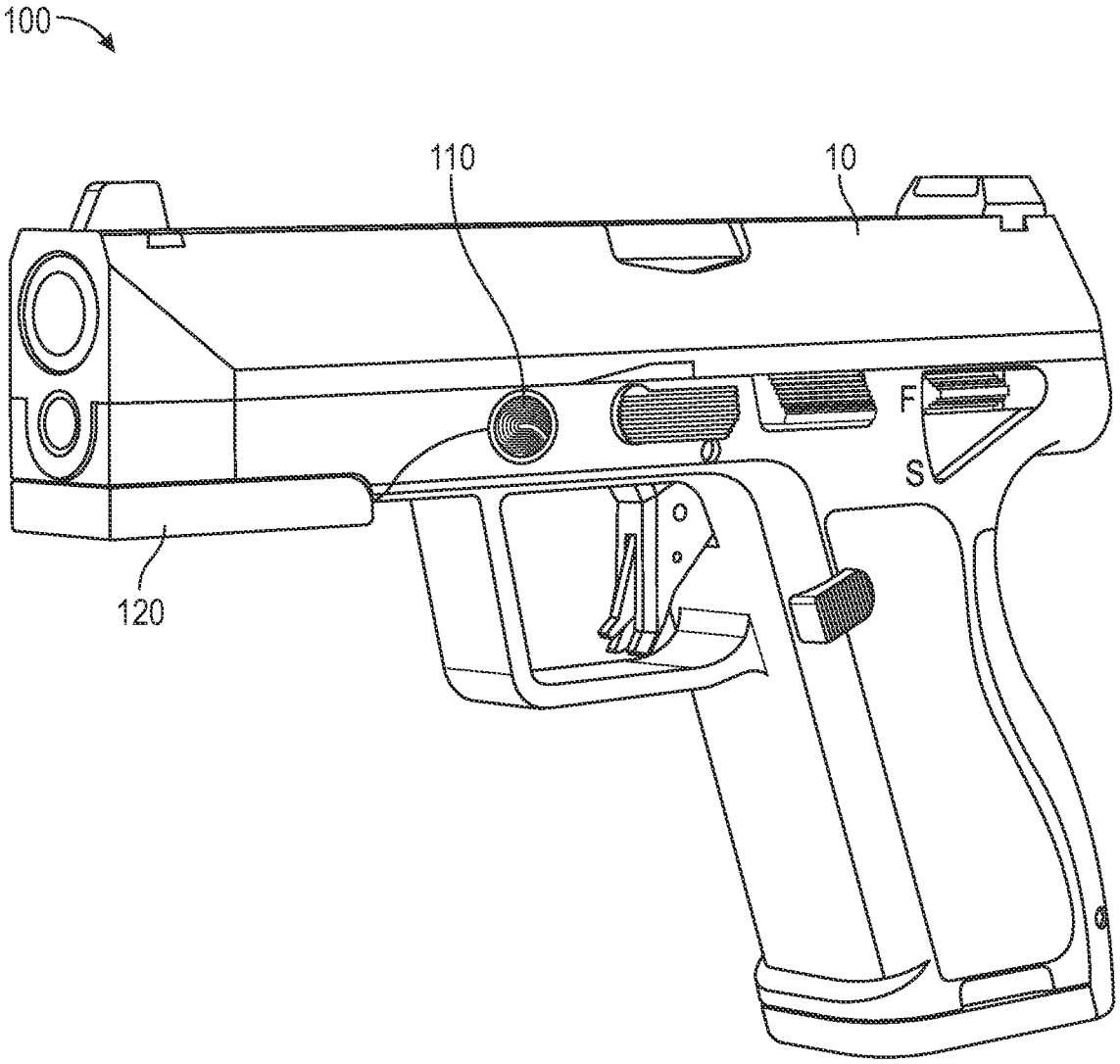
FIG. 1A illustrates a right side perspective view of a firearm security device, according to an exemplary embodiment of the present general inventive concept.

FIG. 1A illustrates a right side perspective view of a firearm security device 100, according to an exemplary embodiment of the present general inventive concept.

Figure 1B:
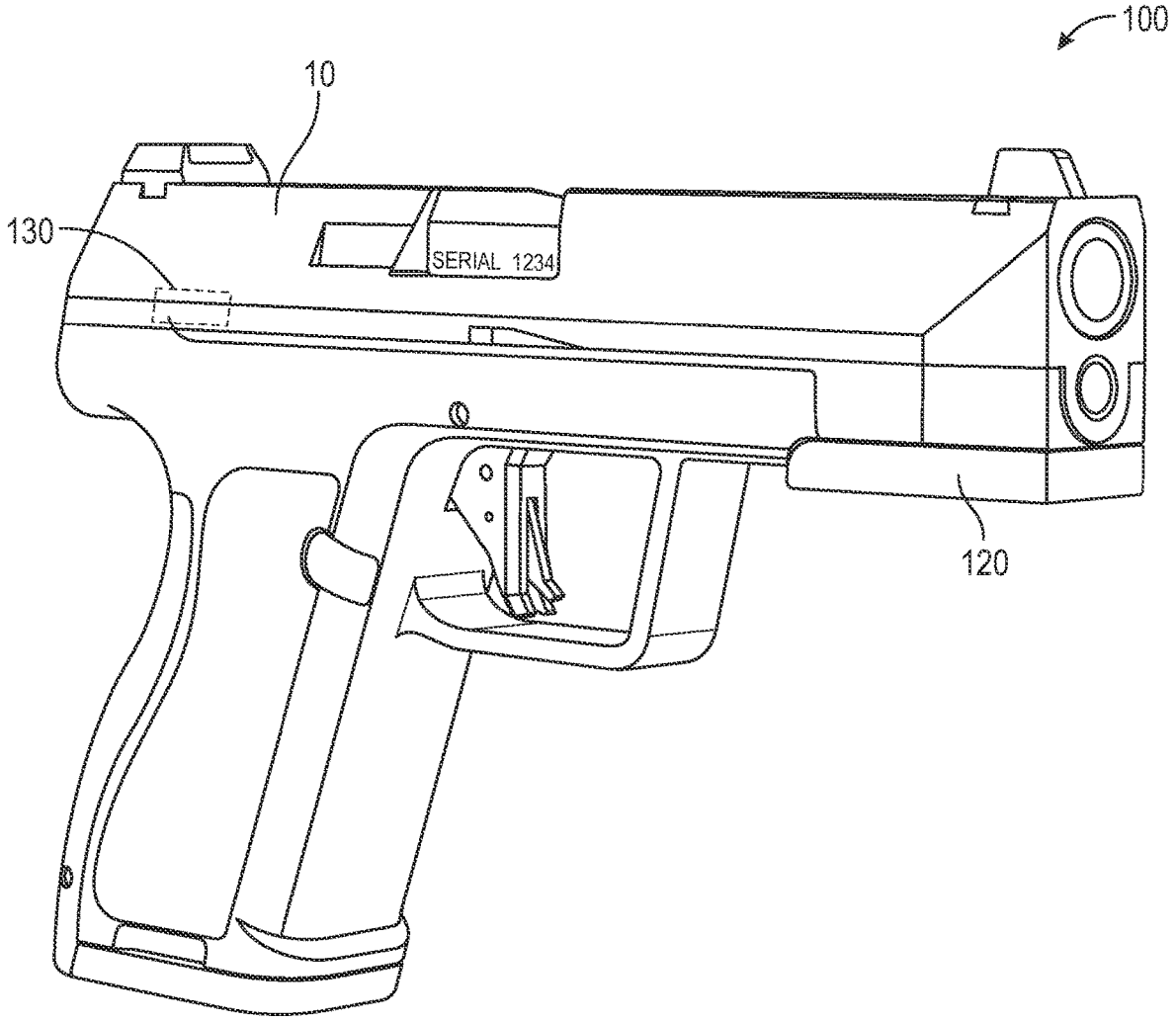
FIG. 1B illustrates a left side perspective view of the firearm security device, according to an exemplary embodiment of the present general inventive concept.

FIG. 1B illustrates a left side perspective view of the firearm security device 100, according to an exemplary embodiment of the present general inventive concept.

The firearm security device 100 may be constructed from at least one of metal, plastic, and rubber, etc., but is not limited thereto.

Referring to FIGS. 1A and 1B, the firearm security device 100 may include a biometric sensor 110, a control unit 120, and a locking pin 130, but is not limited thereto.

The biometric sensor 110 may include a fingerprint sensor, a facial recognition sensor, an iris sensor, a fragrance sensor, a heartbeat sensor, and a heat sensor, but is not limited thereto.

The biometric sensor 110 may be removably connected (e.g., screw, nail, clamp, adhesive, magnet, welding) to at least a portion of a firearm 10 (e.g., a pistol, a rifle, a shotgun, etc.). The biometric sensor 110 may scan a physical characteristic of a user and send biometric data therefrom. For example, the biometric sensor 110 may scan a fingerprint, a face, an eye, a scent of the user, a heartbeat of the user, and/or a temperature level of the user. As such, the biometric sensor 110 may scan for the fingerprint, the face, the scent, the heartbeat, and/or the temperature level recognized as specific to an authorized user.

The control unit 120 may include a processing unit, a communication unit, a storage unit, and a power source, but is not limited thereto.

The processing unit of the control unit 120 (or central processing unit, CPU) may include electronic circuitry to carry out instructions of a computer program by performing basic arithmetic, logical, control and input/output (I/O) operations specified by the instructions. The processing unit of the control unit 120 may include an arithmetic logic unit (ALU) that performs arithmetic and logic operations, processor registers that supply operands to the ALU and store the results of ALU operations, and a control unit that fetches instructions from memory and "executes" them by directing the coordinated operations of the ALU, registers and other components. The processing unit of the control unit 120 may also include a microprocessor and a microcontroller.

The communication unit of the control unit 120 may include a device capable of wireless or wired communication between other wireless or wired devices via at least one of Wi-Fi, Wi-Fi Direct, infrared (IR) wireless communication, satellite communication, broadcast radio communication, Microwave radio communication, Bluetooth, Bluetooth Low Energy (BLE), Zigbee, near field communication (NFC), and radio frequency (RF) communication, USB, global positioning system (GPS), Firewire, and Ethernet.

The storage unit of the control unit 120 may include a random access memory (RAM), a read-only memory (ROM), a hard disk, a flash drive, a database connected to the Internet, cloud-based storage, Internet-based storage, or any other type of storage unit.

The power source of the control unit 120 may include a battery and a solar cell, but is not limited thereto.

The control unit 120 may be removably connected (e.g., screw, nail, clamp, adhesive, magnet, welding) to at least a portion of a barrel of the firearm 10. The control unit 120 may be physically and/or electrically connected to the biometric sensor 110. The control unit 120 may have a program running thereon to interpret the biometric data (e.g., the fingerprint, the face, the eye, the scent of the user, the heartbeat of the user, and/or the temperature level of the user) received from the biometric sensor 110.

More specifically, the control unit 120 may receive the biometric data from the biometric sensor 110. The control unit 120 may compare the biometric data to user data stored on the storage unit of the control unit 120 and/or the user data stored on an external database to determine whether the user is the authorized user of the firearm 10.

The locking pin 130 may include a container of trinitrotoluene, nitroglycerin, picric acid, and/or any other type of explosive, but is not limited thereto. Also, the locking pin 130 may include a container of fluoroantimonic acid, hydrochloric acid, sulfuric acid, and/or any other type of caustic acid, but is not limited thereto.

The locking pin 130 may be removably connected (e.g., screw, nail, clamp, adhesive, magnet, welding) to at least a portion of a trigger bar within (i.e., an interior) the firearm 10. The locking pin 130 may be physically and/or electrically connected to the control unit 120. The control unit 130 may monitor the locking pin 130. Moreover, the control unit 120 may send a destruct command to the locking pin 130 in response to determining the locking pin 130 is in process of being removed and/or or attempting to be removed by the user using an application of force (e.g., pushing, pulling, cutting, etc.). As such, the locking pin 130 may cause a minute explosion and/or dispense contents (e.g., to melt the trigger bar via the acid) therein to destroy the trigger bar within the firearm 10 to prevent the firearm 10 from being used. It is important to note that the explosion used may be enough to damage the locking pin 130 and/or the trigger bar, but otherwise does not exceed a boundary around the trigger bar to cause further damage to the firearm 10.

Accordingly, the control unit 120 may disarm the locking pin 130 in response to determining the biometric data corresponds to the authorized user of the firearm 10. As such, the locking pin 130 may prevent use of the firearm 10 until the locking pin 130 is disarmed. For example, the locking pin 130 may move a shaft thereon to allow the trigger bar to be used after the biometric data has been confirmed as an authorized user. In other words, the locking pin 130 may be disarmed by the control unit 120 in response to the control unit 120 determining the user is an authorized user.

Therefore, the firearm security device 100 may check whether the user is authorized to use the firearm 10. Also, the firearm security device 100 may prevent unauthorized use of the firearm 10 by unregistered users and/or prevent tampering of the firearm 10.

Figure 2A:
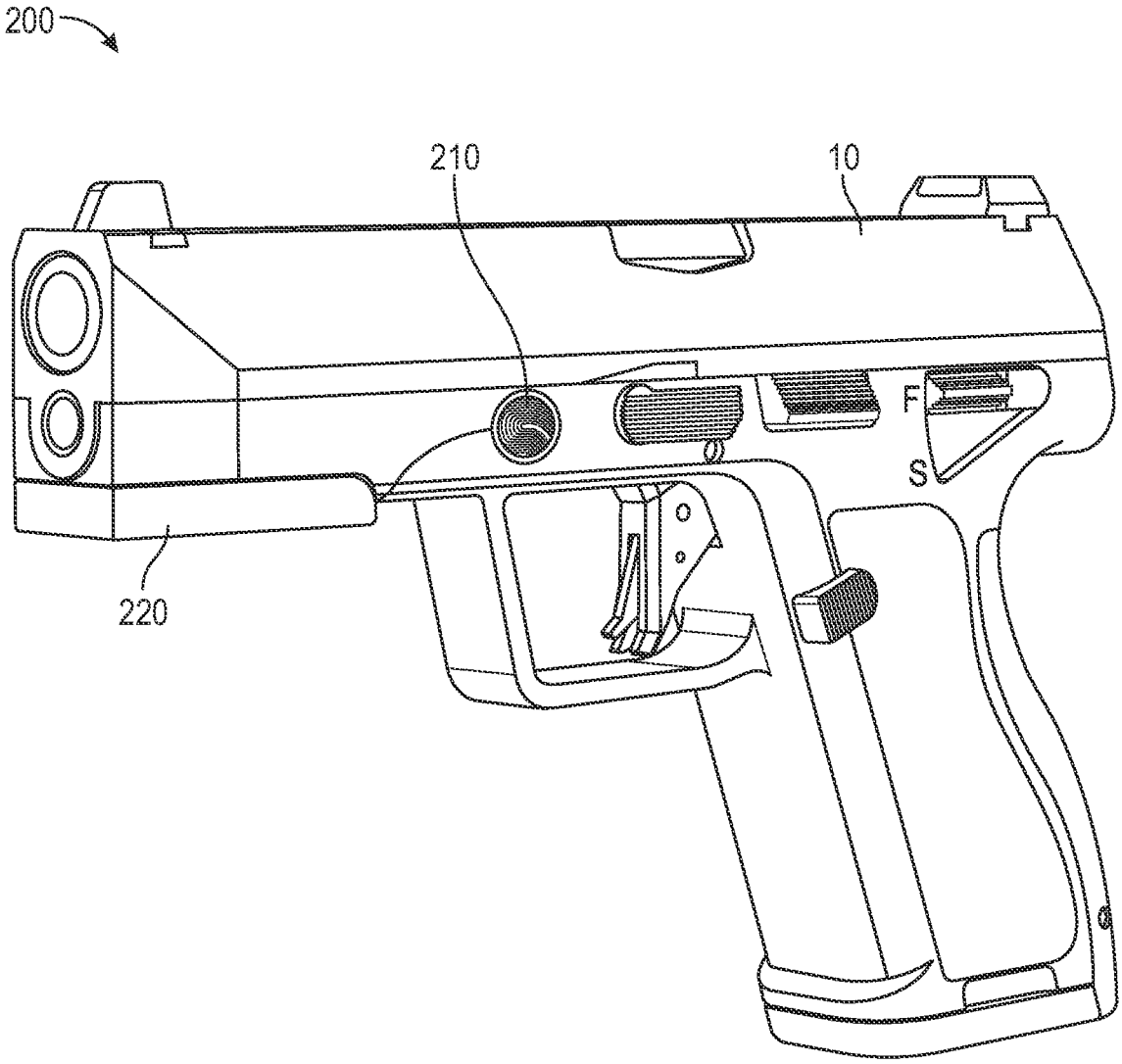
FIG. 2A illustrates a right side perspective view of a firearm security device, according to another exemplary embodiment of the present general inventive concept.

FIG. 2A illustrates a right side perspective view of a firearm security device 200, according to another exemplary embodiment of the present general inventive concept.

Figure 2B:
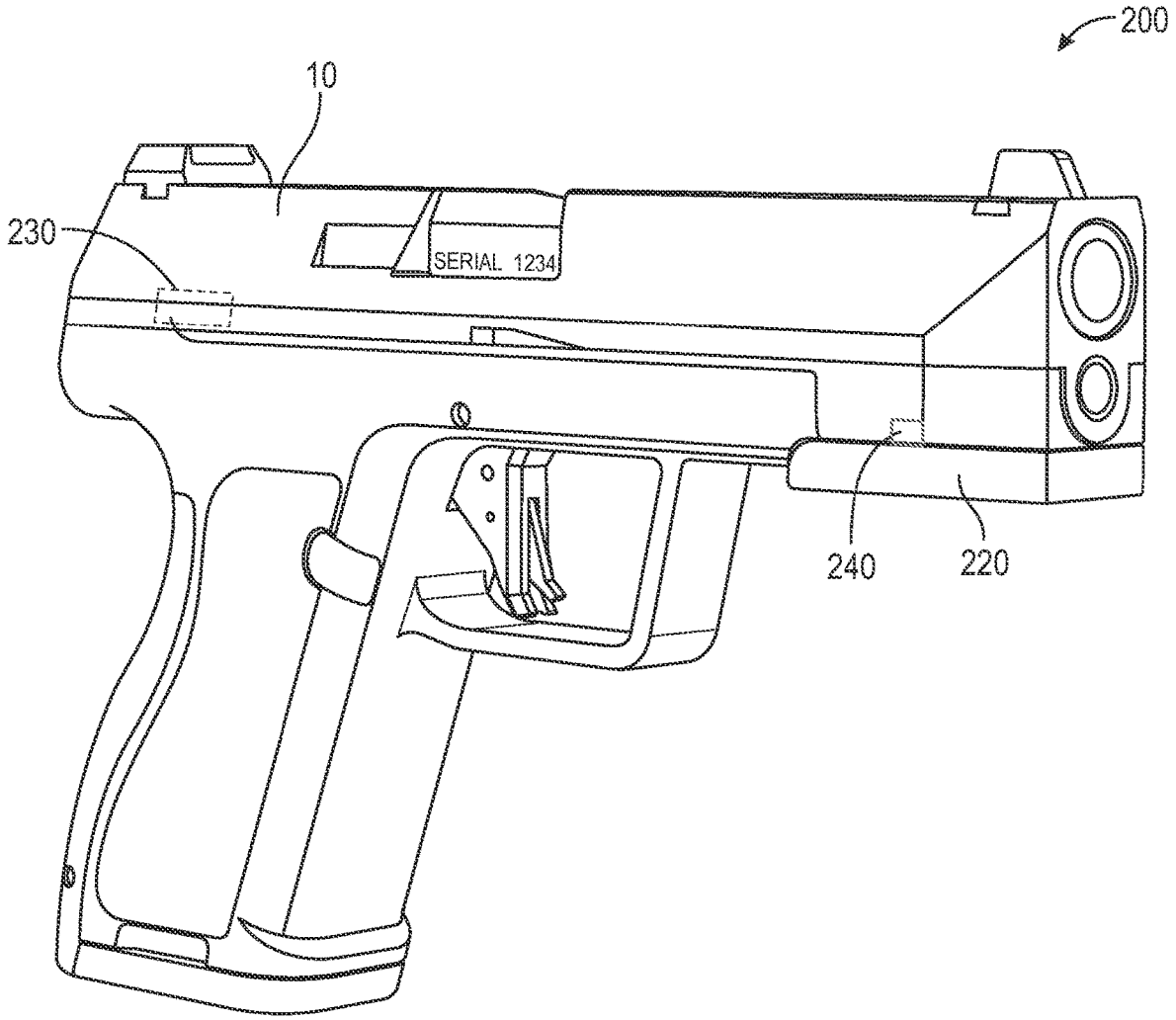
FIG. 2B illustrates a left side perspective view of the firearm security device, according to another exemplary embodiment of the present general inventive concept.

FIG. 2B illustrates a left side perspective view of the firearm security device 200, according to another exemplary embodiment of the present general inventive concept.

The firearm security device 200 may be constructed from at least one of metal, plastic, and rubber, etc., but is not limited thereto.

Referring to FIGS. 2A and 2B, the firearm security device 200 may include a biometric sensor 210, a control unit 220, a locking pin 230, and an indicator 240, but is not limited thereto.

The biometric sensor 210 may include a fingerprint sensor, a facial recognition sensor, an iris sensor, a fragrance sensor, a heartbeat sensor, and a heat sensor, but is not limited thereto.

The biometric sensor 210 may be removably connected (e.g., screw, nail, clamp, adhesive, magnet, welding) to at least a portion of a firearm 10 (e.g., a pistol, a rifle, a shotgun, etc.). The biometric sensor 210 may scan a physical characteristic of a user and send biometric data therefrom. For example, the biometric sensor 210 may scan a fingerprint, a face, an eye, a scent of the user, a heartbeat of the user, and/or a temperature level of the user. As such, the biometric sensor 210 may scan for the fingerprint, the face, the scent, the heartbeat, and/or the temperature level recognized as specific to at least one registered user.

The control unit 220 may include a processing unit, a communication unit, a storage unit, and a power source, but is not limited thereto.

The processing unit of the control unit 220 (or central processing unit, CPU) may include electronic circuitry to carry out instructions of a computer program by performing basic arithmetic, logical, control and input/output (I/O) operations specified by the instructions. The processing unit of the control unit 220 may include an arithmetic logic unit (ALU) that performs arithmetic and logic operations, processor registers that supply operands to the ALU and store the results of ALU operations, and a control unit that fetches instructions from memory and "executes" them by directing the coordinated operations of the ALU, registers and other components. The processing unit of the control unit 220 may also include a microprocessor and a microcontroller.

The communication unit of the control unit 220 may include a device capable of wireless or wired communication between other wireless or wired devices via at least one of Wi-Fi, Wi-Fi Direct, infrared (IR) wireless communication, satellite communication, broadcast radio communication, Microwave radio communication, Bluetooth, Bluetooth Low Energy (BLE), Zigbee, near field communication (NFC), and radio frequency (RF) communication, USB, global positioning system (GPS), Firewire, and Ethernet.

The GPS of the control unit 220 may facilitate tracking of the firearm 10 using an external device (e.g., a mobile device, a cell phone, a tablet computer, a laptop computer) to locate a GPS signal. Thus, the at least one registered user may locate the firearm 10 when misplaced and/or lost.

The storage unit of the control unit 220 may include a random access memory (RAM), a read-only memory (ROM), a hard disk, a flash drive, a database connected to the Internet, cloud-based storage, Internet-based storage, or any other type of storage unit.

The power source of the control unit 220 may include a battery and a solar cell, but is not limited thereto.

The control unit 220 may be removably connected (e.g., screw, nail, clamp, adhesive, magnet, welding) to at least a portion of a barrel (e.g., a picatinny rail, rail interface) of the firearm 10. The control unit 220 may be physically and/or electrically connected to the biometric sensor 210. The control unit 220 may have a program running thereon to interpret the biometric data (e.g., the fingerprint, the face, the eye, the scent of the user, the heartbeat of the user, and/or the temperature level of the user) received from the biometric sensor 210.

More specifically, the control unit 220 may receive the biometric data from the biometric sensor 210. The control unit 220 may compare the biometric data to user data stored on the storage unit of the control unit 220 and/or the user data stored on an external database (e.g., a national database, registry, etc.) to determine whether the user is the at least one registered user of the firearm 10.

Figure 3:
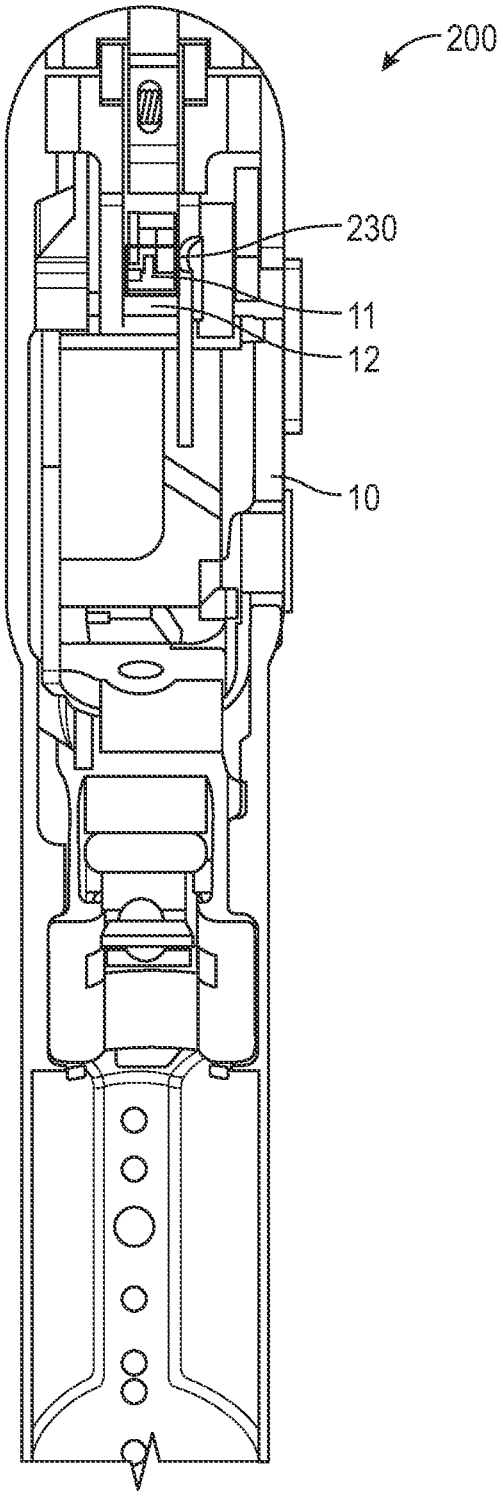
FIG. 3 illustrates a sectional view of the firearm security device, according to another exemplary embodiment of the present general inventive concept.

FIG. 3 illustrates a sectional view of the firearm security device 200, according to another exemplary embodiment of the present general inventive concept.

The locking pin 230 may include a solenoid, but is not limited thereto. More specifically, the locking pin 130 may be constructed as an electromagnet formed by a helical coil of wire and generates a magnetic field.

Referring to FIG. 3, the locking pin 230 may be removably connected (e.g., screw, nail, clamp, adhesive, magnet, welding) to at least a portion of a trigger bar 11 within (i.e., an interior) the firearm 10. Additionally, the trigger bar 11 may be connected to a rear portion of a firing pin 12 and prevents the firing pin 12 from moving forward until a trigger of the firearm 10 is pulled, which moves the trigger bar 11 to allow the firing pin 12 to contact a primer of a projectile (e.g., a bullet). The locking pin 230 may be installed by a professional using welding and/or soldering onto the trigger bar 11.

The locking pin 230 may prevent movement of the trigger bar 11, such that the trigger of the firearm 10 is prevented from moving the trigger bar 11 to fire the projectile. Additionally, the locking pin 230 may prevent use of the trigger bar 11 in response to being removed. As such, the firearm 10 would be rendered inoperative and unable to fire.

The locking pin 230 may be physically and/or electrically connected to the control unit 220. The control unit 230 may monitor the locking pin 230. Moreover, the control unit 220 may send a permanent lock command to the locking pin 230 in response to determining the locking pin 230 is in process of being removed and/or or attempting to be removed by the user using an application of force (e.g., pushing, pulling, cutting, etc.). As such, the locking pin 230 may prevent any movement of the locking pin 230 to prevent the firearm 10 from being used, and therefore, permanently disabling the firearm 10.

Accordingly, the control unit 220 may retract the locking pin 230 away from (i.e., off) the trigger bar 11 in response to determining the biometric data received by the biometric sensor 210 corresponds to the at least one registered user of the firearm 10. As such, the locking pin 230 may prevent use of the firearm 10 until the locking pin 230 is disarmed. For example, the locking pin 230 may move from adjustment of the magnetic field by the control unit 220 to allow the trigger bar to be used after the biometric data has been confirmed as the at least one registered user. In other words, the locking pin 230 may be disarmed by the control unit 220 in response to the control unit 220 determining the user is the at least one registered user.

Also, the control unit 220 executing the program may set a timer for a predetermined period of time (e.g., one minute, two minutes, five minutes, ten minutes, etc.) to automatically move the locking pin 230 onto the trigger bar 11 after the control unit 220 determines the firearm 10 has fired a projectile to prevent further use. The control unit 220 may automatically set the timer and/or be preconfigured by the at least one registered user and/or a manufacturer. As such, the control unit 220 may enforce safety to ensure the at least one registered user is continuing to use the firearm 10.

The indicator 240 may be disposed on at least a portion of the firearm 10 and/or connected to the control unit 220. The indicator 240 may illuminate a first color (e.g., green) to indicate the locking pin 230 has been retracted (i.e., unlocked) from the trigger bar 11 and illuminate a second color (e.g., red) to indicate the locking pin 230 is engaged (i.e., locked) on the trigger bar 11. As such, the indicator 240 may illuminate to identify a current status of the locking pin 230 with respect to the trigger bar 11.

Therefore, the firearm security device 200 may check whether the user is authorized to use the firearm 10. Also, the firearm security device 200 may prevent unauthorized use of the firearm 10 by unregistered users and/or prevent tampering of the firearm 10.

The present general inventive concept may include a firearm security device 100 removably connected to at least a portion of a firearm 10, the firearm security device 100 including a biometric sensor 110 to scan a physical characteristic of a user and send biometric data therefrom, a control unit 120 running a program thereon and connected to the biometric sensor 110 to compare the biometric data received from the biometric sensor 110 to user data to determine whether the user is an authorized user of the firearm 10, and a locking pin 130 disposed on a trigger bar of the firearm 10 and connected to the control unit 120 to prevent use of the firearm 10 until the control unit 120 determines the user is authorized to use the firearm 10.

The biometric sensor 110 may scan for at least one of a fingerprint, a face, an eye, a scent, a heartbeat and a temperature level of the user.

The locking pin 130 may contain at least one of an explosive and a caustic acid therein.

The locking pin 130 may destroy the trigger bar in response to the control unit 120 determining the locking pin 130 is being removed or attempting to be removed by the user using an application of force.

The present general inventive concept may also include a firearm security device 200 connected to at least a portion of a firearm 10, the firearm security device 200 including a biometric sensor 210 to scan a physical characteristic of a user and send biometric data therefrom, a control unit 220 running a program thereon and connected to the biometric sensor 210 to compare the biometric data received from the biometric sensor 210 to user data to determine whether the user is at least one registered user of the firearm 10, and a locking pin 230 comprising a solenoid disposed on a trigger bar 11 of the firearm 10 and connected to the control unit 220 to prevent use of the firearm 10 until the control unit 220 retracts the locking pin 230 from the trigger bar 11 in response to determining the user is authorized to use the firearm 10.

The biometric sensor 210 may scan for at least one of a fingerprint, a face, an eye, a scent, a heartbeat and a temperature level of the user.

The control unit 220 may set a timer for a predetermined period of time to automatically move the locking pin 230 onto the trigger bar 11 after the control unit 220 determines the firearm 10 has fired a projectile.

The locking pin 230 may move in response to adjustment of a magnetic field of the locking pin 230 by the control unit 220.

The firearm security device 200 may further include an indicator 240 connected to the control unit 220 to illuminate at least one color to identify a current status of the locking pin 230 with respect to the trigger bar 11.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A firearm security device removably connected to at least a portion of a firearm, the firearm security device comprising:

a biometric sensor to scan a physical characteristic of a user and send biometric data therefrom;

a control unit running a program thereon and connected to the biometric sensor to compare the biometric data received from the biometric sensor to user data to determine whether the user is an authorized user of the firearm; and a locking pin disposed on a trigger bar of the firearm and connected to the control unit to prevent use of the firearm until the control unit determines the user is authorized to use the firearm, such that removal of the locking pin from the trigger bar renders the firearm inoperable and unable to fire.

2. The firearm security device of claim 1, wherein the biometric sensor scans for at least one of a fingerprint, a face, an eye, a scent, a heartbeat and a temperature level of the user.

3. The firearm security device of claim 1, wherein the locking pin contains at least one of an explosive and a caustic acid therein.

4. The firearm security device of claim 1, wherein the locking pin destroys the trigger bar in response to the control unit determining the locking pin is being removed or attempting to be removed by the user using an application of force.

5. A firearm security device connected to at least a portion of a firearm, the firearm security device comprising:

a biometric sensor to scan a physical characteristic of a user and send biometric data therefrom;

a control unit running a program thereon and connected to the biometric sensor to compare the biometric data received from the biometric sensor to user data on a database to determine whether the user is at least one registered user of the firearm; and a locking pin comprising a solenoid disposed on a trigger bar of the firearm and connected to the control unit to prevent use of the firearm until the control unit retracts the locking pin from the trigger bar in response to determining the user is authorized to use the firearm, such that removal of the locking pin from the trigger bar renders the firearm inoperable and unable to fire.

6. The firearm security device of claim 5, wherein the biometric sensor scans for at least one of a fingerprint, a face, an eye, a scent, a heartbeat and a temperature level of the user.

7. The firearm security device of claim 5, wherein the control unit sets a timer for a predetermined period of time to automatically move the locking pin onto the trigger bar after the control unit determines the firearm has fired a projectile.

8. The firearm security device of claim 5, wherein the locking pin moves in response to adjustment of a magnetic field of the locking pin by the control unit.

9. The firearm security device of claim 5, further comprising:

an indicator connected to the control unit to illuminate at least one color to identify a current status of the locking pin with respect to the trigger bar.

* * * * *